United States Patent [19]

Stockman

[11] 4,284,125

[45] Aug. 18, 1981

[54] FAIL SAFE ARRANGEMENT

[75] Inventor: Richard F. Stockman, Friendship, N.Y.

[73] Assignee: The Air Preheater Company, Inc., Wellsville, N.Y.

[21] Appl. No.: 76,056

[22] Filed: Sep. 17, 1979

[51] Int. Cl.[3] ..... F28D 19/00

[52] U.S. Cl. ..... 165/9

[58] Field of Search ..... 165/9

[56] References Cited

U.S. PATENT DOCUMENTS

| | | | |
|---|---|---|---|
| 3,373,797 | 3/1968 | Nyberg | 165/9 |
| 3,669,183 | 6/1972 | Mock | 165/9 |
| 4,122,891 | 10/1978 | Baber | 165/9 |
| 4,124,063 | 11/1978 | Stockman | 165/9 |
| 4,206,803 | 6/1980 | Finnemore et al. | 165/9 |

*Primary Examiner*—Albert W. Davis

*Attorney, Agent, or Firm*—Wayne H. Lang

[57] ABSTRACT

Rotary regenerative heat exchange apparatus having a rotor of heat absorbent material that is alternately exposed to hot and cold fluids in order that heat absorbed from the hot fluid may be transferred to the cold fluid. The rotor is surrounded by a housing including sector plates at opposite ends of the rotor that are arranged to separate the hot from the cold fluids. Fail safe apparatus is provided to quickly release a sector plate from a position where it is held in close proximity to the rotor whereby a sudden variation of conditions will not permit mutual interference between relatively rotating parts.

6 Claims, 3 Drawing Figures

FAIL SAFE ARRANGEMENT

BACKGROUND OF THE INVENTION

In rotary regenerative heat exchange apparatus a mass of heat absorbent material commonly comprised of packed element plates is first positioned in a hot gas passageway to absorb heat from hot gases passing therethrough. After the plates become heated by the hot gases they are moved into a passageway for cool air or other fluid where the then hot plates transmit their absorbed heat to the cooler air.

The heat absorbent material is carried into a rotor that rotates between hot and cool fluids, while a fixed housing including sector plates at opposite ends of the rotor is adapted to surround the rotor and direct the several fluids therethrough. To prevent mingling of the hot and cold fluids, the end edges of the rotor are provided with flexible sealing members that rub against the adjacent surface of the sector plates to accommodate a limited amount of rotor "turndown" or other distortion caused by mechanical loading or thermal deformation of the rotor.

To permit turning the rotor freely about its axis, certain minimum clearance space between the rotor seals and sector plates of the adjacent rotor housing is desirable, but excessive clearance space is to be avoided because it will dictate excessive leakage. Therefore the rotor seals are "set" to provide an optimum clearance space. Thus movement of the rotor away from the sector plates will cause excessive leakage and a lowering of effectiveness, while movement of the rotor toward the adjacent sector plates will cause interference therebetween and excessive wear.

An arrangement that provides for movement of a sector plate to accommodate thermal deformation of the rotor is shown by U.S. Pat. No. 4,124,063. The arrangement shown by this patent in most cases will provide an optimum sealing arrangement. In practice, a typical arrangement may include a sensor rod that extends axially into a housing surrounding the rotor to detect deformation. Since an extremely rapid change of temperature may produce rapid thermal deformation, interference between parts and a complete destruction of the rotor seals may occur before the usual adjusting means acts to maintain the parts at their predetermined clearance.

SUMMARY OF THE INVENTION

In accordance with this invention, I therefore provide a fail safe arrangement whereby sudden thermal distortion of the rotor will actuate a trigger holding a spring biased mechanism. The trigger releases the sensor rod with a "snap action" that permits a spring to move it away from the rotor quickly to thus eliminate the tendency toward interference, abrasion and destruction of the sealing surface or other rotor parts.

BRIEF DESCRIPTION OF THE DRAWING

The invention will be more fully understood by referring to the accompanying drawing in which.

DESCRIPTION OF THE PREFERRED EMBODIMENT

Figure 1:
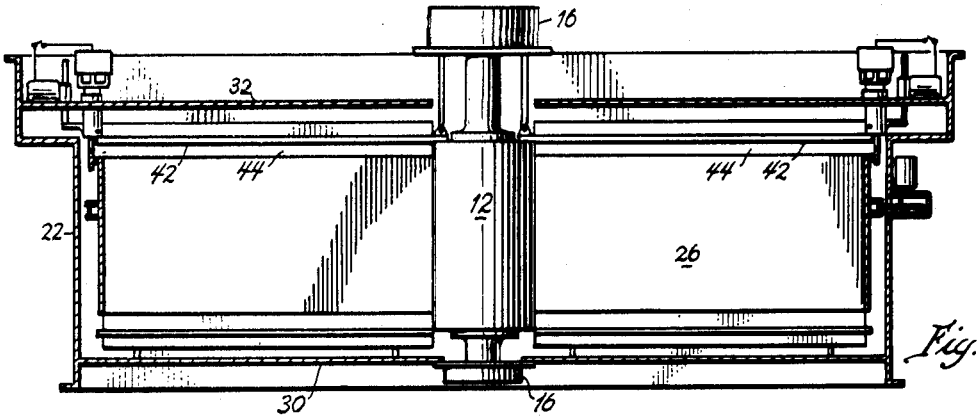
FIG. 1 is a sectional elevation of an air preheater having a rotor surrounded by a housing and movable sector plates in accordance with the present invention.
Figure 2:
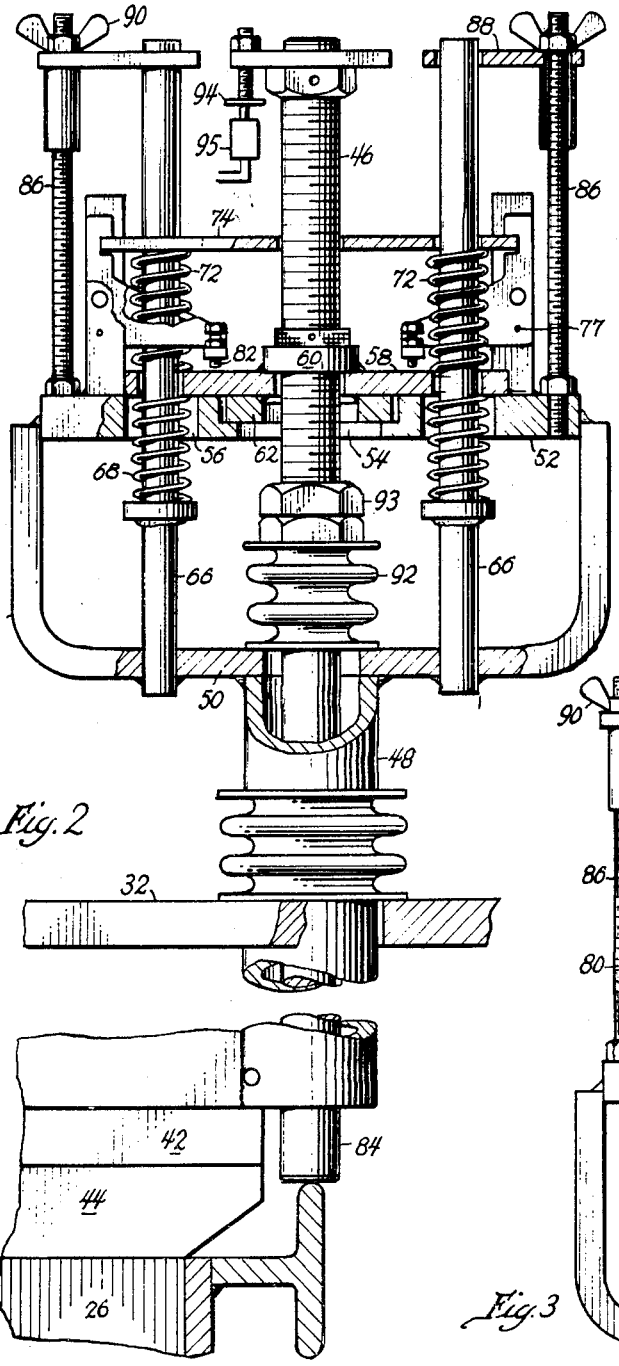
FIG. 2 is an enlarged section of a fail safe apparatus according to this invention in a "cocked" condition.

The arrangement of the drawing is directed to a rotary regenerative heat exchanger having a rotor post 12 that is rotatably supported at opposite ends thereof by bearings 16. A rotor shell 22 is connected to the rotor post to form compartments for a mass of heat absorbent material 26. The rotor is contained in housing structure 28 having end plates 30–32 with openings at opposite ends thereof whereby a heating fluid and a fluid to be heated may simultaneously flow in opposite directions through the rotor and the heat exchange material carried thereby. The rotor is rotated about its axis by a conventional drive motor and reducing gear.

To preclude fluid from leaking into or out of the rotor, housing sector plates 42 are provided intermediate the ends of the rotor and the adjacent housing structure, and flexible sealing means 44 are provided on the end edges of the rotor to rub against each sector plate or lie in close proximity thereto.

In most heat exchangers of the type defined herein, hot gas enters the top of the heat exchanger and transfers its sensible heat to the heat exchange material of the rotor before it is discharged as a cooled gas through an outlet duct. Inasmuch as the inlet for the cool air lies at the bottom of the heat exchanger adjacent the cooled gas, the bottom of the heat exchanger is called the "cold" end while the end lying adjacent the hot gas inlet is termed the "hot" end of the rotor. It will be apparent that the "hot" end of the rotor will be subject to maximum temperature variation, while the "cold" end will be subjected to a lesser amount, causing the rotor to become distorted like an inverted dish called rotor "turndown".

Movable sector plates that automatically adjust the sector plates at the "hot" end of the rotor have been disclosed in my U.S. Pat. No. 4,124,063 and in the U.S. Pat. No. 4,122,891 of Roderick J. Baker. In both of these patents, the sector plate is forced to closely conform to known rotor "turndown" to minimize fluid leakage.

In practice, a sensor rod carried by the rotor housing is adapted to extend axially into contact with the end edge of the rotor. The sensor rod is adapted to follow any variation in the rotor turndown, but a rapid temperature change frequently results in rapid turndown, more rapid and extensive than the sensor rod can follow. When conditions change rapidly, the end edges of the rotor including the sealing means frequently interfere with the remote end of the sensor rod causing breakage of interfering parts and a loss of sealing effectiveness.

This invention is therefore directed to an arrangement by which a sensor rod that extends axially into contact with an end edge of a rotor may be quickly retracted from an operating position whereby any change in operating conditions will not effect interference between relatively moving parts.

According to this invention a sensor rod, threaded at its top end 46, extends axially through a tubular housing 48 mounted on the upper end plate 32. The upper end of tubular housing 48 is connected to an inverted U-shaped housing 50 that has a central opening therein superimposed upon the central opening of tube 48, while the lower end of the tubular housing 50 is pivotally attached to the sector plate 42. A plate 52 having a central opening 54 and symmetrically aligned openings 56 is connected to opposite ends of plate 52 to permit the sensor rod 46 to extend through the central opening thereof. A pressure plate 58 having a central opening therein is placed around the sensor rod and welded to a nut 60 which has been screwed on the threaded portion of the sensor rod. The pressure plate 58 is then tack welded to the top of an apertured plate 62 which rests on a seat formed by the top surface of plate 52.

Rods 66 extend axially through openings 56 and are secured as by welding to the bottom of member 50. Coil type compression springs 68 are placed concentrically around rods 66 and adapted to bear against the underside of pressure plate 58 to provide an upward force on the pressure plate and the sensor rod 46 which is connected thereto.

The pressure plate 58 is held down by compression springs 72 that are compressed by a sear plate 74. The springs 72 are of heavier gauge than springs 68 whereby when springs 72 are compressed, they overcome the upward force of springs 68 and permit plate 58 to lie seated against plate 52.

The sear plate is held down against the force of springs 68 and 72 by a notch 76 in trigger 78, while a shear pin 77 between the trigger and its support 84 prevents premature operation. The trigger 78 is, in effect, a bell-crank which is pivoted at 80 to an upright member 84 supported by the plate 52. The notch 76 is contained in a vertical arm of the bell-crank, and the horizontal arm thereof is adapted to carry a screw type contact 82 that may be adjusted vertically to provide a predetermined clearance between the end of contact 82 and the upper surface of plate 58 whereby upward movement of plate 58 will effect movement of the bell-crank about pivot 82 and movement of notch 76 away from the periphery of sear plate 74. When not being held down by notch 76 in the plate 74, the light springs 72 expand and remove their pressure from the upper side of plate 58 thereby permitting the heavy spring 68 to suddenly expand and actuate the compression plate 58 and the axially disposed sensor rod 46 up and away. As the upper end of sensor rod 46 and plate 58 are suddenly moved away from fixed plate 52, the lower end of rod 46 shown at 84 is similarly retracted upward so that it cannot interfere with seals or other structural parts of the rotor.

Figure 3:
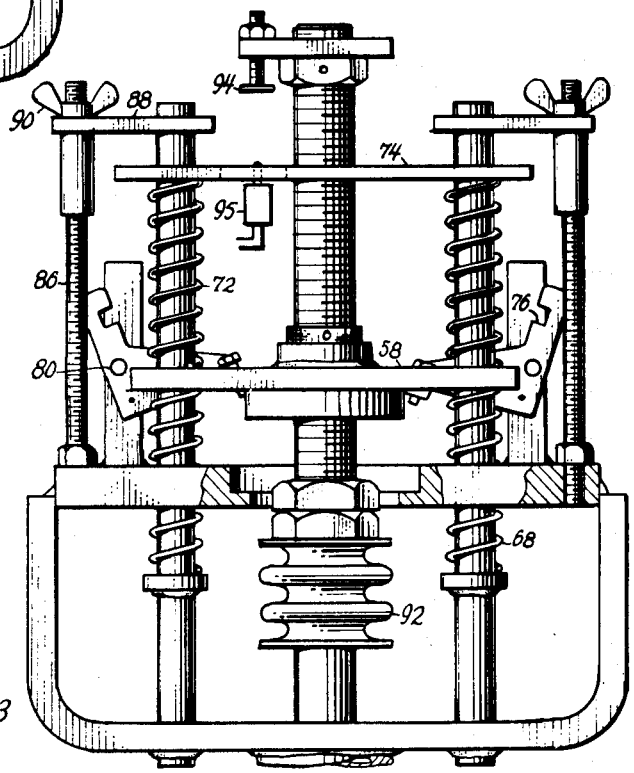
FIG. 3 is a partial view of an enlarged section of a fail safe apparatus in a "snapped" condition.

Threaded rods 86 at the side of rods 66 are provided to permit cocking plates 88 to be brought to bear against the upper side of sear plate 74 by the turning of thumb screws 90. As the thumb screws are rotated, the cocking plate 88 is brought to bear upon the top of sear plate 74 and the springs 68 and 72 are slowly compressed. As the springs are compressed, pressure plate 58 is lowered and each bell-crank slowly turns about pivot 80 until the periphery of sear plate 74 can be held by notches 76 of the trigger 78 (bell-crank). At this point the thumb screws 90 are backed off to permit full expansion of springs 68 and 72 when the sear plate is released in the manner shown by FIG. 3.

Conventional bellows type sealing means 91 are provided between the cylindrical housing 48 and end plate 32 to preclude the leakage of fluid while permitting relative movement therebetween. Similar bellows type sealing means 92 are arranged concentrically around the sensor rod 46 and adapted to abut the housing to preclude the entrance or escape of fluid. Lock-nut arrangement 93 permits axially adjusting bellows 92 to obtain suitable closing pressure on the upper end thereof to provide effective sealing at operating pressures.

The upper end of sensor rod 46 includes an axially adjustable contact point 94 that may be adjusted to depress relay 95 when in the "cocked" condition as shown in FIG. 1. When the sear plate 74 is released, the sensor rod snaps upward to permit contact 94 to suddenly move away from the relay and break contact therewith. The relay 95 operates conventional equipment that motivates the sector plate in accordance with standard practice that does not comprise a part of this invention.

What is claimed is:

1. Rotary regenerative heat exchange apparatus having a rotor including a central rotor post and a concentric rotor shell spaced therefrom to provide an annular space therebetween, a mass of heat absorbent material carried in the annular space between the rotor post and the rotor shell, a housing surrounding the rotor in spaced relation to include inlet and outlet ducts at opposite ends thereof for a heating fluid and for a fluid to be heated, means for rotating the rotor about its axis, a sector plate intermediate the end of the rotor and the rotor housing adapted to maintain the heating fluid separate from the fluid to be heated, support means for a sector plate at the inboard end of the rotor, actuating means at the outboard end of the sector plate adapted to deform the sector plate to conform to the profile of the rotor, an axially disposed sensor rod reciprocally mounted on said housing and having an end face thereof abutting an axial edge of the rotor, and a snap-acting release means responsive to movement of the sensor rod adapted to move said sensor rod rapidly away from the rotor to preclude interference therebetween.

2. Rotary regenerative heat exchange apparatus as defined in claim 1 including a cylindrical housing mounted on said housing and adapted to contain the sensor rod.

3. Rotary regenerative heat exchange apparatus as defined in claim 2 wherein the snap-acting release means is mounted on an end of the cylindrical housing and is adapted to be actuated by axial movement of the sensor rod.

4. Rotary regenerative heat exchange apparatus as defined in claim 3 wherein the snap-acting release means includes a delay mechanism that actuates the sensor rod when axial distortion of the rotor exceeds a predetermined amount.

5. Rotary regenerative heat exchange apparatus as defined in claim 4 including a pressure plate fixed transversely to said sensor rod whereby said pressure plate is adapted to move vertically in response to axial deformation of the rotor, and means that moves the sensor rod rapidly after a predetermined minimum movement of the pressure plate.

6. Rotary regenerative heat exchange apparatus as defined in claim 5 including spring means biasing the pressure plate and the sensor rod away from the rotor, a sear plate above the pressure plate lying parallel thereto, a set spring intermediate the pressure plate and the sear plate forcing the plates apart, a trigger mechanism interlocking with the sear plate to hold the set spring in compression between the sear plate and the pressure plate, and a relief spring on the underside of said pressure plate biasing the sensor rod upward when the pressure plate moves upward to release the sear plate and the set spring therebetween.

* * * * *